US008500519B2

(12) United States Patent
Seyffert et al.

(10) Patent No.: US 8,500,519 B2
(45) Date of Patent: Aug. 6, 2013

(54) FLUID JET ASSEMBLY

(75) Inventors: Casparus Jan Hendrik Seyffert, Solvang, CA (US); Andrey D. Atanassov, Sarasota, FL (US)

(73) Assignee: Cobra North America, LLC, Centennial, CO (US)

( * ) Notice: Subject to any disclaimer, the term of this patent is extended or adjusted under 35 U.S.C. 154(b) by 958 days.

(21) Appl. No.: 12/512,874

(22) Filed: Jul. 30, 2009

(65) Prior Publication Data

US 2010/0093261 A1 Apr. 15, 2010

Related U.S. Application Data

(60) Provisional application No. 61/137,600, filed on Jul. 30, 2008.

(51) Int. Cl.
*B24C 5/02* (2006.01)

(52) U.S. Cl.
USPC ..... 451/90; 451/40

(58) Field of Classification Search
USPC ..... 451/90, 99, 75, 102, 38, 39, 40
See application file for complete search history.

(56) References Cited

U.S. PATENT DOCUMENTS

| | | | | |
|---|---|---|---|---|
| 835,541 | A | 11/1906 | Leisegang | |
| 1,655,767 | A | 1/1928 | Hoevel | |
| 2,038,249 | A * | 4/1936 | Stoody | 451/102 |
| 2,792,671 | A * | 5/1957 | Sprigg et al. | 451/102 |
| 4,901,928 | A * | 2/1990 | Abbott et al. | 239/530 |
| 5,083,402 | A | 1/1992 | Kirschner et al. | |
| 5,407,379 | A | 4/1995 | Shank et al. | |
| 5,605,496 | A * | 2/1997 | Pickard | 451/102 |
| 2009/0250231 | A1 * | 10/2009 | Larsson | 169/70 |

OTHER PUBLICATIONS

Fairhurst, R.M. et al, "Diajet—A New Abrasive Water Jet Cutting Tool," Proceedings of the 8th International Symposium on Jet Cutting Technology, Durham, UK, Sep. 9-11, 1985, pp. 395-402.

Summers, D.A., "Waterjetting Technology," Chapters 1 through 12, published by E & FN Spon, an imprint of Chapman & Hall, London, UK, 1995.

Graettinger, A.J. et al., "Foundation Evaluation with Micro Intrusive Testing," University Transportation Center for Alabama (UTCA), University of Alabama, UTCA Report No. 01114, Dec. 2002, 36 pages.

Jetstream of Houston, Inc., Catalog, http://www.asiawaterjet.com/Jetstream-2520MainCatalog.pdf, 1998.

(Continued)

*Primary Examiner* — Robert Rose
(74) *Attorney, Agent, or Firm* — HolzerIPLaw, PC

(57) ABSTRACT

A fluid jet assembly includes a non-pressurized lance barrel through which a high pressure hose ("a lance hose") is threaded and anchored at the distal end of the lance barrel relative to an operator's position. The other end of the lance hose is coupled to a high pressure fluid source. The fluid is fed into the lance hose and transported to the output of the lance barrel, where it is discharged as a fluid jet stream. A nozzle is mounted at the output of the lance barrel to control the characteristics of the fluid jet flowing out of the lance hose. When infused with an abrasive material, the fluid jet stream exits the nozzle in a focused jet capable of cutting through most structural surfaces.

19 Claims, 11 Drawing Sheets

OTHER PUBLICATIONS

A typical spraying gun that might be attached to a garden hose, http://www.aquatix-2u.co.uk/acatalog/adjustable__car__care__spray__gun.html), downloaded Dec. 28, 2010, 1 page.

A higher pressure control system, http://www.northerntool.com/shop/tools/product__273__273, downloaded Dec. 28, 2010, 2 pages.

A lance extension to fit into a pressure washer gun, http://www.pressureparts.com/ImageView.aspx??code=4760262, downloaded Dec. 28, 2010, 1 page.

A conventional high pressure cleaning lance, http://www/advancedpressuresystems.com/40K-Water-BlastingProducts.htm?cat=10, downloaded Dec. 28, 2010, 2 pages.

A two-trigger gun, http://www.advancedpressuresystems.com/APS-control-gun-html?cat=5, downloaded Dec. 28, 2010, 2 pages.

A disassembled two-trigger gun, http://www.advancedpressuresystems.com/images/PDF/15K-Hand%20Guns-2010-Catalog-Pages.pdf, downloaded Dec. 28, 2010, 1 page.

Ultra-high pressure nozzle assemblies, http:www.alljetting.com/controlgunds.htm, downloaded Dec. 28, 2010, 1 page.

An ultra-high pressure cleaning lance assembly, http://www.alljetting.com/controlguns.htm, downloaded Dec. 28, 2010, 1 page.

An abrasive injection lance, http://www.aquamiser.com/blasting-guns.html, downloaded Dec. 28, 2010, 1 page.

A high-pressure gun with hose connection in front of the trigger, http://woma-products.com/pdf/p__tools__e.pdf, downloaded Dec. 28, 2010, 1 page.

Protective pipe in tube cleaning, http://www.peinemannequipment.com/products/bundle__cleaning/single__lance__tube__cleaner/, downloaded Dec. 28, 2010, 2 pages.

* cited by examiner

FLUID JET ASSEMBLY

CROSS-REFERENCE TO RELATED APPLICATIONS

The present application claims benefit of priority to U.S. Provisional Patent Application No. 61/137,600, entitled "Ultra High Pressure Fire Attack System" and filed on Jul. 30, 2008, specifically incorporated by reference herein for all that it discloses or teaches.

The present application also relates to U.S. Nonprovisional patent application Ser. No. 12/512,910, entitled "Fluid Jet Manifold" and filed on Jul. 30, 2009, specifically incorporated by reference herein for all that it discloses or teaches.

BACKGROUND

Fluid jet systems have many applications, such as firefighting, surface cleaning, hydroexcavation, demolition, machining, mining, etc. Typical fluid jet systems provide a cutting or abrading function by projecting a jet of fluid at high velocity and pressure at a structure or surface. The specific fluid employed depends on the application. For example, for firefighting applications, a combination of water and an abrasive material may be employed to penetrate a wall or ceiling of a structure having a fire within, and upon creating a hole in the wall or ceiling, the abrasive material flow may be terminated while continuing the water flow through the hole to knock down the fire.

However, existing fluid jet systems have certain design features that present safety and maintenance concerns. High pressure fluids present safety risks, particularly when operated near humans and property. For example, a high pressure coupling positioned near an operator's head presents a risk that the coupling may fail during operation, after which the high pressure hose can whip about until the pressure is terminated.

Further, the use of an abrasive material presents challenges in maintaining the system components. For example, pumps and valves tend to break down quickly if abrasive material flows through the components.

SUMMARY

Implementations described herein address the foregoing problems by providing a novel fluid jet assembly having a non-pressurized lance barrel through which a high pressure hose ("a lance hose") is inserted and anchored at the distal end of the lance barrel, relative to an operator's position. The other end of the lance hose is coupled to a high pressure fluid source. In this manner, the fluid can be fed into the lance hose and transported to the output of the lance barrel, where it is discharged as a fluid jet stream.

A nozzle is mounted at the distal end of the lance barrel, at the output of the lance hose, to control the characteristics of the fluid jet flowing out of the lance hose. For example, in one implementation, fluid is discharged from the lance hose under high pressure and through the nozzle to yield a fluid jet stream having droplets of appropriate size and velocity to effectively knock down a fire within a closed space. When infused with an abrasive material, the fluid jet stream exits the nozzle in a focused jet capable of cutting through most structural surfaces.

The lance hose extends from an anchor point of the distal end of the lance barrel back toward a proximal end of the fluid jet assembly and then to a high pressure coupling positioned at a safe distance from the fluid jet assembly. This high pressure coupling connects the lance hose to a high pressure hose extending from a fluid jet base station, which provides the high pressure flow of fluid (e.g., water, water and abrasive, water and foam, etc.).

Other implementations are also described and recited herein.

BRIEF DESCRIPTIONS OF THE DRAWINGS

DETAILED DESCRIPTIONS

Figure 1:
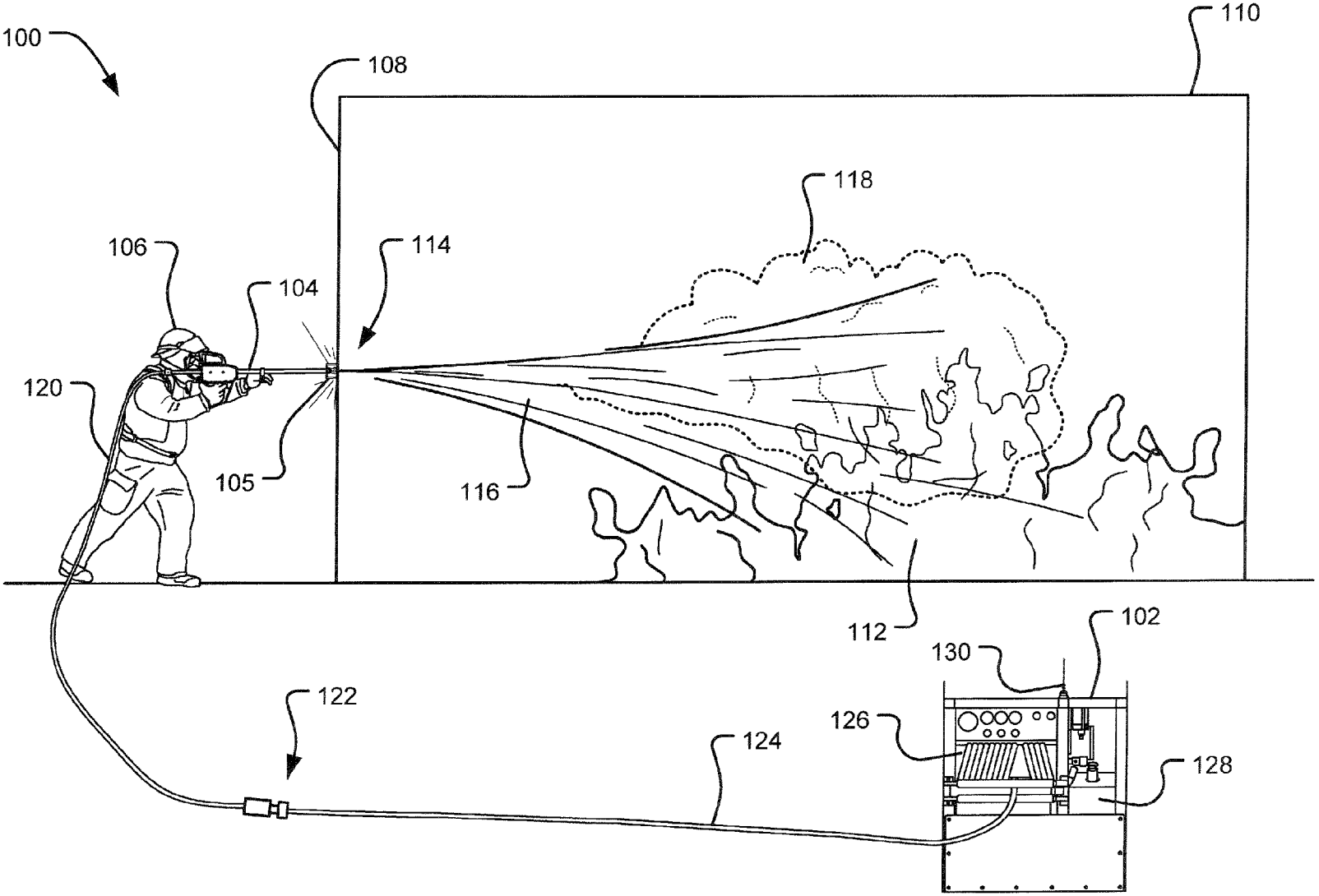
FIG. 1 illustrates an example of a fluid jet system used in a firefighting application, the example fluid jet system including a fluid jet base station and a fluid jet assembly.

FIG. 1 illustrates an example of a fluid jet system 100 used in a firefighting application, the example fluid jet system including a fluid jet base station 102 and a fluid jet assembly 104 (also referred to as lance 104). Example fluids may include without limitation water, combinations of water and an abrasive material, combinations of water and foam, etc. The specific fluid employed depends on the application. Under certain circumstances, for example, a flow of fire retardant foam may be combined with the water flow to enhance the suppression of the fire (e.g., coating the fire's fuel to reduce its contact with oxygen).

In the example shown in FIG. 1, a firefighter 106 is shown holding the distal end of the lance 104 against a wall 108 (or door) of an enclosure 110 in which a fire 112 is burning. The lance 104 includes a rigid lance barrel through which high pressure fluid flows during operation. The rigid lance barrel allows the firefighter 106 to accurately direct the fluid flow and to steady the lance 104 against a surface, such as the wall 108. The firefighter 106 initially cuts through the wall 108 using a combined flow of high pressure water and abrasive material. When the wall 108 is penetrated, the firefighter ceases the flow of abrasive material while continuing the flow of water, which streams into the enclosure 110 through the newly cut hole 114 in the wall 108 in a high pressure jet 116 having small water droplet size (e.g., approximately 0.0059 inches or 150 microns in diameter) and a high velocity (e.g., approximately 400-450 mile per hour or 200 meters per second). The water characteristics are such that water jet extends a considerable distance (e.g., over 40 feet) into the enclosure 110, despite convection currents caused by the fire 112, and knocks down the fire 112. Much of the water in the high pressure jet 116 is vaporized (as shown by steam 118), reducing the intensity of the fire 112 and the temperature in the enclosure 110. In this manner, the fluid jet system 100 knocks down the fire and makes it safer for firefighters to enter the enclosure 110 to progress their firefighting activities. However, it should be understood that technology described and claimed herein may be employed in other applications, including surface cleaning, hydroexcavation, demolition, machining, mining, etc.

In preparation for applying the fluid jet system 100 to the fire 112 in the enclosure 110, the firefighter 106 takes a steady stance, holds the lance 104 against his shoulder and with both hands (e.g., one hand in the trigger guard of the lance 104 and the other on a handle located forward of the trigger guard on the lance barrel), and places a placement structure at the distal end of the lance 104 against the wall 108. In one implementation, the placement structure is embodied by a 3-pronged offset fixture 105 with a splash plate to protect the operator from spray-back of fluid and debris during the cutting operation. Other placement structures may be employed to steady or aim the fluid jet at a target region of a structure. In some implementations, cutting performance of the fluid jet is improved if the placement structure allows the operator to "wiggle" the fluid jet about the target region. In this manner, the hole that is cut in the structure by the fluid jet develops as larger diameter than the fluid jet itself, thereby allowing fluid and debris to evacuate during the cutting operation.

In the illustrated implementation, the lance 104 includes two triggers: (1) a trigger to control the flow of water from the fluid jet base station 102 through the lance 104; and (2) a trigger to control the flow of abrasive material from an abrasives holding tank in the fluid jet base station 102 through the lance 104. To commence the cutting stage, the firefighter 106 pulls both triggers and a combined flow of water and abrasive material flows at high velocity against the wall 108, quickly cutting a small hole through the wall 108. After the wall 108 is penetrated by the water/abrasive material combination, the firefighter 106 releases the abrasive material trigger and continues the flow of high pressure water through the lance 104, through the hole in the wall 108, and into the enclosure 110 to knock down the fire 112.

The lance 104 includes a lance hose 120, which threads through the barrel of the lance 104 and is anchored to the distal end of the lance 104. The lance hose 120 threads out of the proximal end of the lance 104 a safe distance (e.g., from a few feet to over several yards away) away from the firefighter 106 to a high pressure coupling 122, which couples the lance hose 120 to a base station hose 124.

The fluid jet base station 102 includes a motorized hose reel 126 that allows the base station hose 124 to be extended during operation and retracted during storage. In the illustrated implementation, the fluid jet base station 102 also includes, among other components, a power source (such as a diesel or gasoline engine), a fluid source (such as a water intake hose or reservoir), an abrasives holding tank 128, a communications system (see antenna 130), a high pressure pump, multiple valves with one or more valve manifolds, and a flow junction for combining multiple flows (e.g., a water flow and an abrasive material flow).

Figure 2:
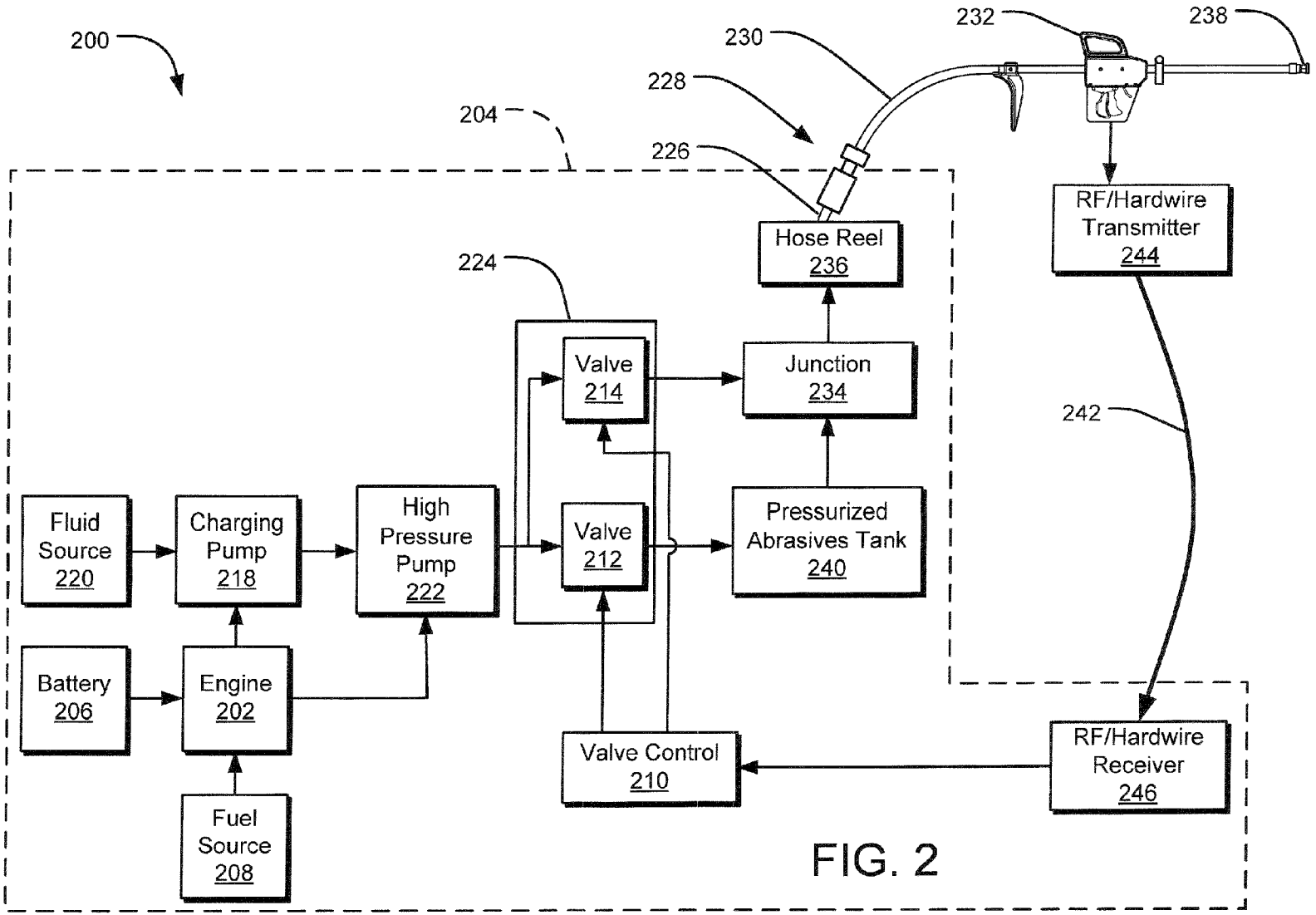
FIG. 2 illustrates a hydraulic schematic of an example fluid jet system.

FIG. 2 illustrates a hydraulic schematic of an example fluid jet system 200. An engine 202 powers a fluid jet base station 204. In one implementation, the engine 202 is embodied by a single DEUTZ naturally aspirated 50 hp diesel engine, although other engines or power sources may be employed, including gasoline engines, electric motors, hybrid engines, etc. In the system illustrated in FIG. 2, an electricity source, such as a battery 206, provides electrical power for an automatic ignition used to start the engine 202 and a fuel source 208 (e.g. a diesel fuel tank) provides fuel to the engine 202. The battery 206 also provides power to a valve control circuit 210, valves 212 and 214 and a radio frequency (RF) or hardwire receiver 216. Although more than one engine may be employed, the single normally aspirated DEUTZ air cooled diesel engine 202 provides consistent power and allows sufficient operation under almost any weather conditions and altitudes. Further, the engine 202 provides a very short start-up time and rapid deployment of the fluid jet system 200 without complicated control systems and frequent maintenance.

The engine 202 provides power to a charging pump 218, which pulls fluid from a fluid source 220, such as a water intake or reservoir, and provides a fluid flow with positive pressure for the input of a high pressure pump 222. The high pressure pump 222 is driven by the main shaft of the engine 202 via a poly carbon drive belt. In one implementation, the pump 222 is capable of discharging fluid at a pressure of approximately 4,400 PSI (300 bar) at a flow rate of 15 gallons per minute (GPM) (60 liters per minute) via a 1.2 inch outer diameter, 0.5 inch inner diameter high pressure hose system (e.g., a base station hose 226, a coupling 228, and a lance hose 230). It should be understood that other dimensions of hose may also be employed.

In one implementation, the pump 222 may be embodied by a single UDOR ultra high pressure force pump having dimensions of 15" L×16.5" W×9" H, although other pump assemblies may be employed. An example pump 222 may include without limitation a 35 mm solid keyed shaft, a brass manifold, a stainless steel check valve, stainless steel plungers, bronze connecting rods, tapered roller hearings, solid ceramic plungers, a heat treated crankshaft, a heavy duty flat base, high pressure seals, and an 80 oz oil crank case, although other designs may be employed.

The pump 222 drives fluid at high pressure into the valves 212 and 214, which are set in a manifold 224. The valves 212 and 214 are independently controlled by the valve control circuit 210, which can be controlled wirelessly or via a hardwired communications link from a lance 232, or alternatively via a manual override circuit having access to the base station 204.

The valve 214 drives high pressure fluid through the junction 234 and the hose reel 236 into the high pressure hose assembly, through the lance 232 and out a nozzle 238 of the lance 232. The other valve 212 feeds into a pressurized abrasives holding tank 240, which contains abrasive material that improves the cutting performance of the fluid flow during a cutting stage of operation. In one implementation, the pressurized abrasives holding tank 240 is a 2.5 gallon vessel mounted to the base station 204. An abrasive material, such as PYROSHOT abrasive additive, another inert, non-metallic abrasive material, such as sand, diamond-cut granite, ground garnet, etc., or some other abrasive material, is loaded into the abrasives holding tank 240, which is then pressurized with fluid flow from the value 212 when the valve 212 is opened. When the valve 212 drives pressurized fluid through the abrasives holding tank 240, a combination of fluid and abrasive is driven to a junction 234, where it combines with the fluid flow from the valve 214. As such, when both valve 212 and valve 214 are open, a combination of abrasive material and fluid is driven out of the abrasives holding tank 240 and through the high pressure hose assembly and the lance 232 to the nozzle 238 for application to the target surface, such as to cut through a structure or clean the target surface.

In one implementation, a single manifold block 224 contains the valves 212 and 214 and regulates the pressure of the fluid flow output from each valve to achieve a desired mixture ratio of abrasive material to fluid, although it should be understood that each valve 212 and 214 may have its own separate containment. In one implementation, 5% of the fluid output from the lance 232 is abrasive material, although other mixture ratios may be employed. For example, 8% is also proposed as an effective mixture ratio. It is believed that a mixture ratio of between 2.5% and 40% may be acceptable, but for some applications, the mixture ratio may fall outside of this range. To achieve a desired mixture ratio, considering the additional hydraulic resistance introduced in the abrasives line by the abrasives holding tank 240, the individual outputs of each valve 212 and 214 are fed through individual channels of the manifold 224, wherein each manifold channel is preconfigured to achieve the appropriate abrasive-to-fluid mixture ratio.

The valves 212 and 214 can be controlled remotely from the lance 232 via a wireless (RF) or hardwired communications link 242. A transmitter 244 in (or communicatively coupled to) the lance 232 transmits signals to a receiver 246 in (or communicatively coupled to) the base station 204. The lance 232 includes separate triggers to independently control the flows of fluid and abrasive material through the system (although, in one implementation, abrasive material flow fed by the valve 212 is restricted when no fluid flows through valve 214). Each trigger sends signals to the base station 204 to open or close the valves 212 and 214. An operator can close neither trigger (e.g., the system is in standby mode), one of the triggers (e.g., typically, only fluid without abrasive material flows), or both triggers (e.g., both fluid and abrasive material flows). For example, to execute a cutting operation, a firefighter closes both triggers to cut a hole in a structure using a high pressure combination of water and abrasive material; to execute the knock down operation on the fire, the firefighter closes only the trigger controlling the valve 214, which provides high pressure water through the newly cut hole and into a burning room on the other side of the structure.

FIGS. 3-7 illustrate various views of a fluid jet base station 300 for an example fluid jet system, although it should be understood that alternative implementation may be employed. Various components of the base station 300 may be found in any of FIGS. 3-7, although such components may be discuss with regard to a specific Figure even if the component is not visible in that Figure.

Figure 3:
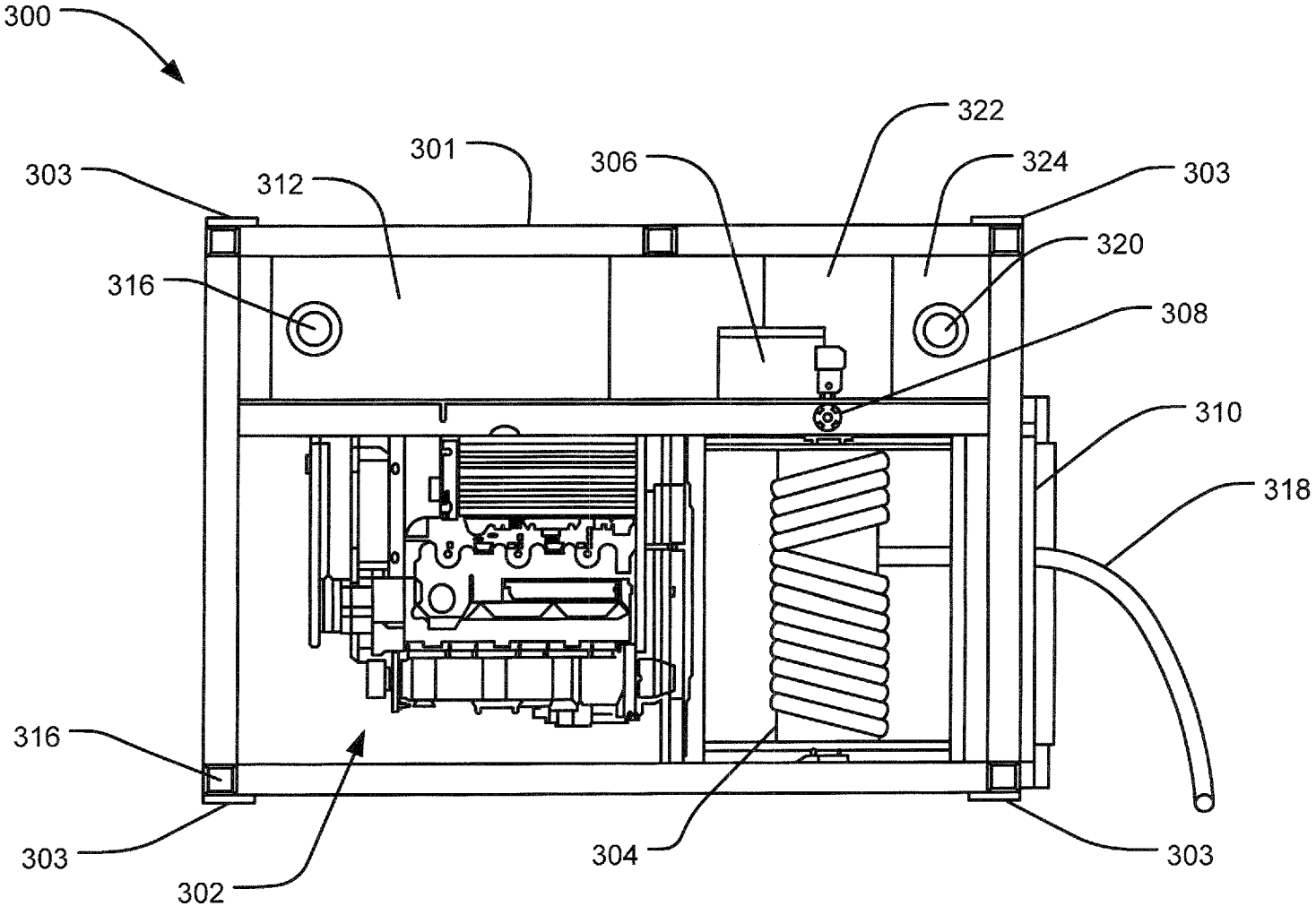
FIG. 3 illustrates a plan view of a fluid jet base station for an example fluid jet system.

FIG. 3 illustrates a plan view of a fluid jet base station 300 for an example fluid jet system. The base station 300 is generally housed within a sturdy steel frame 301. In one implementation, the frame 301 is 48 inches by 34 inches by 36 inches, and the self-contained base station 300 weighs approximately 1500 pounds. The frame 301 includes several sturdy steel eyelets 303 to facilitate transport of the base station 300 to a location of operation (e.g., the eyelets can receive cabling to secure the base station 300 on a truck or fork lift).

The base station 300 is powered by an engine 302 to drive a charging pump, if appropriate, and a high pressure pump 332 (see FIG. 7) and provides electrical power to a motorized hose reel 304, a communications system (see receiver module 306 and antenna 308), and a control system (see control panel 310). The engine 302 receives fuel from a fuel tank 312 and electrical current from a battery 314 (see e.g., FIG. 4). Access to the fuel tank 312 (e.g., for refueling) is provided through fuel input 316.

The base station 300 includes the hose reel 304, which allows or employs a motor to assist extension of the base station hose 318 as the operator carries the lance (see e.g., lance 104 of FIG. 1) to a remote location (e.g., to an outside wall of a burning structure). The base station hose 318 is typically connected to a lance hose (see e.g., lance hose 120 of FIG. 1) via a high pressure coupling (see e.g., coupling 122 of FIG. 1). The motor of the hose reel 304 also assists with retraction of the base station hose 318 when extending the base station hose 318 is no longer needed.

The base station 300 also includes a pressurized abrasives holding tank 326 (see FIG. 4 and see e.g., abrasives holding tank access 320 and faces 322 and 324 of the abrasives holding tank compartment in FIG. 3) that stores abrasive material and feeds the abrasive material into the fluid flow during a cutting operation. The high pressure pump 332 drives fluid at a high pressure into the abrasives holding tank 326 (see FIG. 4) when the appropriate manifold valve is open. It should be understood that cutting is merely an example application of the abrasive material flow. Other applications, such as surface cleaning, hydroexcavation, demolition, drilling, mining, etc. may also employ an abrasive material flow.

Figure 4:
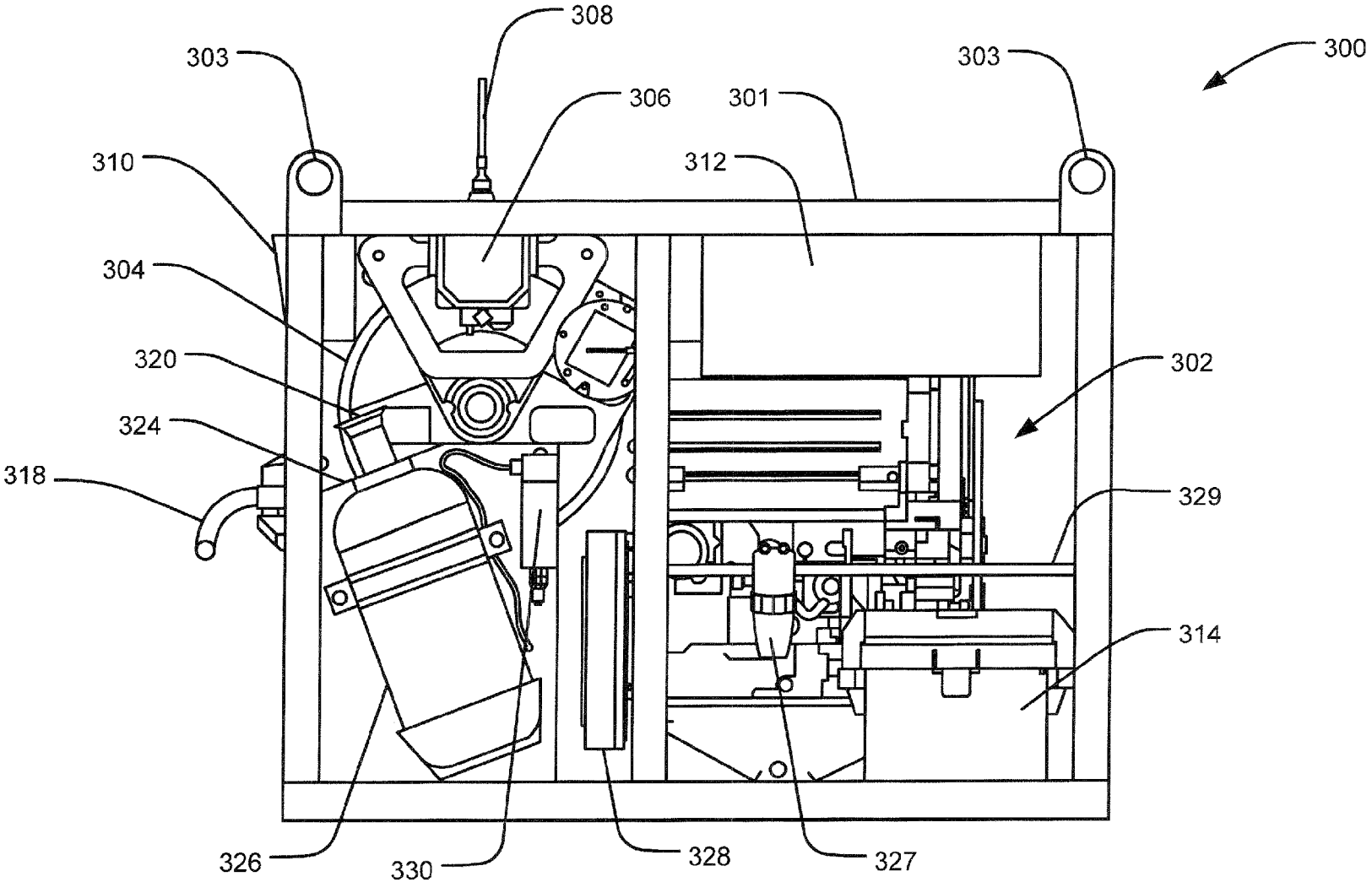
FIG. 4 illustrates a right side view of a fluid jet base station for an example fluid jet system.

FIG. 4 illustrates a right side view of a fluid jet base station 300 for an example fluid jet system. The engine 302 is shown with the fuel tank 312 and battery 314. A drive belt drive 328 is shown powered by the engine 302. The drive belt 328 drives the high pressure pump 332 (see FIG. 7). An inline filter 327 is shown with an intake pipe 329 (extending from the periphery of the base station 300 and connecting to the side of the inline filter 327) and an outlet pipe (extending from the other side of the inline filter 327 into the interior of the base station 300 to feed into the high pressure pump 332). The intake pipe 329 can be connected to a fluid source, such as a hose from a fluid reservoir of a nearby fire truck. In one implementation, an inline charging or supply pump (not shown) may also be used to maintain input pressure on the high pressure pump 332. This charging or supply pump may be driven by a second drive belt (not shown) powered by the engine 302.

The engine 302 and the other components of the base station are mounted to the frame 301, which has eyelets to assist with transport. An antenna 308, with receiver module 306, is mounted at the top of the frame 301 to facilitate reception of wirelessly transmitted commands from the lance. A control panel 310 is mounted on the front of the frame 301 to present gauges and various operator-accessible controls. The base station hose 318 extends out the front of the base station 300 from the motorized hose reel 304.

An abrasives holding tank 326 is contained within an abrasives holding tank compartment (see e.g., compartment face 324). Two manifold valves and a shared manifold 330 are mounted within the abrasives holding tank compartment to regulate the flows of fluid and abrasive material. The inputs to the valves are driven by the high pressure pump 332 and the manifold 330 has output for each valve, one of which feeds into the abrasives holding tank 326 and the other which feeds into a junction (not shown) to combine with output flow from the abrasives holding tank 326.

Figure 5:
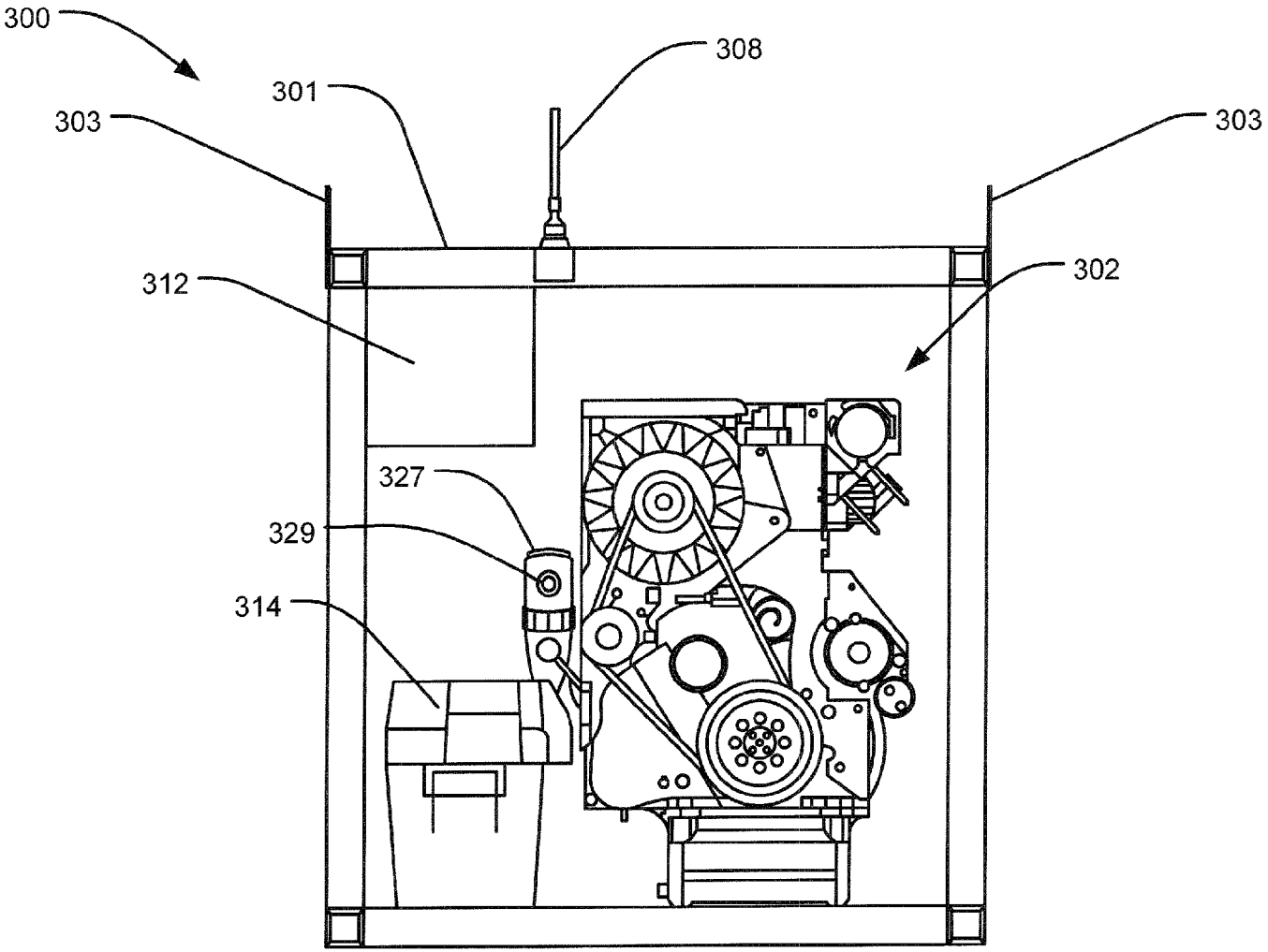
FIG. 5 illustrates a back view of a fluid jet base station for an example fluid jet system.

FIG. 5 illustrates a back view of a fluid jet base station 300 for an example fluid jet system. A majority of the base station components are not visible in the view for FIG. 5. Nevertheless, the engine 302, the battery 314, the fuel tank 312, the eyelets 303, the inline filter 327, the intake pipe 329, and the antenna 308 are illustrated in FIG. 5 being mounted to the frame 301.

It should be understood, however, that alternative implementations may be employed. For example, in one implementation, the fluid jet base station is mounted in or to a vehicle for transport. For example, components of the base station may be separately mounted to a fire department vehicle and powered by an auxiliary drive train connected to the vehicle's engine. The hose reel is mounted to an operator-accessible compartment on the vehicle to allow an operator to connect the base station hose to a lance hose. The operator can then extend the base station hose to pull the lance into the specific area of operation (e.g., against a wall to a burning structure).

Figure 6:
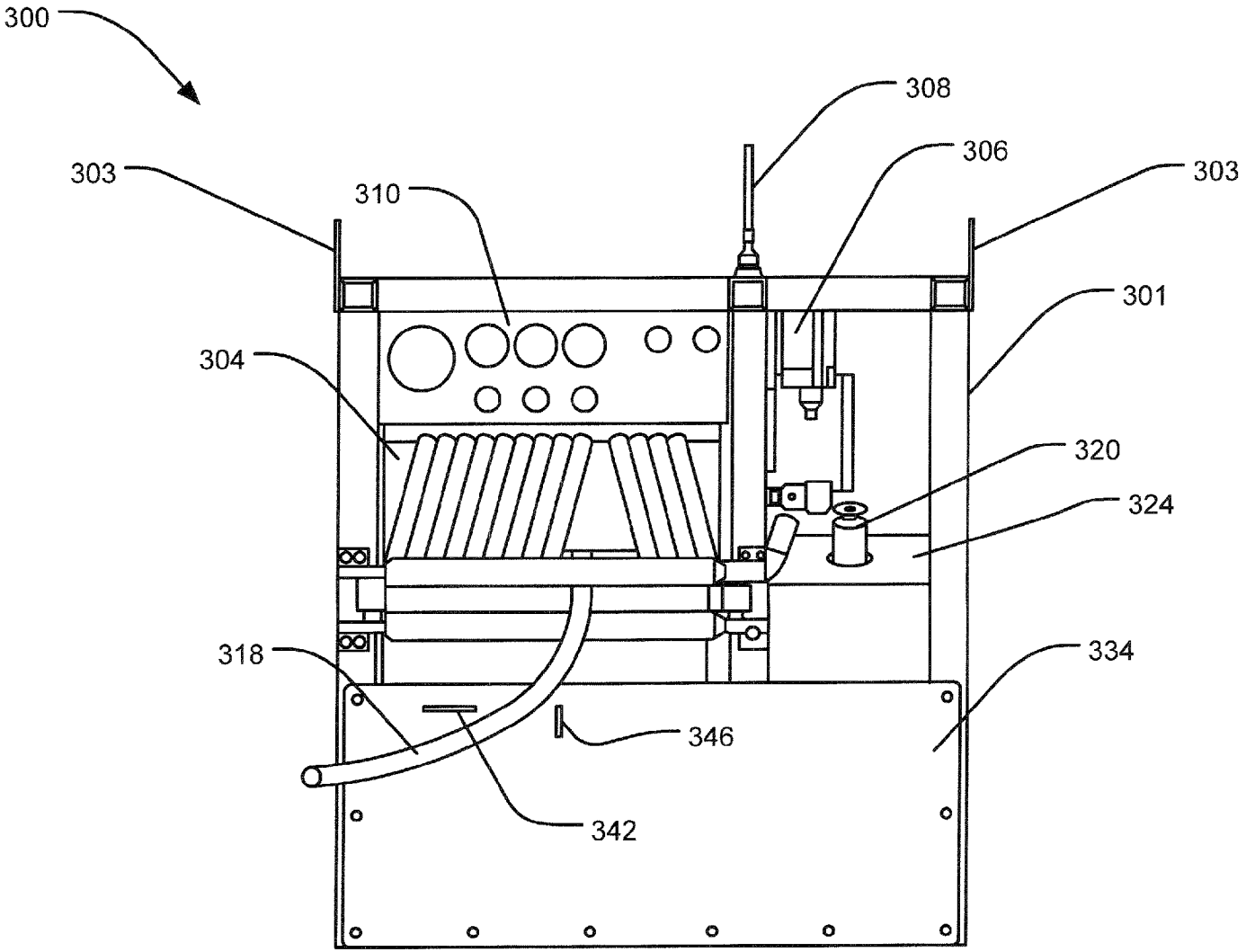
FIG. 6 illustrates a front view of a fluid jet base station for an example fluid jet system.

FIG. 6 illustrates a front view of a fluid jet base station 300 for an example fluid jet system. The frame 301 is shown supporting the antenna 308, a receiver module 306, the abrasives holding tank compartment 324 with tank access 320, the motorized hose reel 304, and the control panel 310. The base station hose 318 extends from a railed opening mounted on the frame 301 in front of the hose reel 304. A kick plate 324 is also mounted on the frame 301. The high pressure pump 332 (see FIG. 7) is mounted to the frame 301 behind the kick plate 324, beneath the hose reel 304. Eyelets 303 are shown at the top of the frame 301.

A priming pump handle 342 for a priming pump 344 is accessible through the kick plate 334 to allow an operator to manually prime the high pressure pump 332 (e.g., by pulling the priming pump handle 342 in and out relative to the priming pump 344). During a priming operation, a priming valve control 346, also accessible through the kick plate 334, is set to a horizontal priming position. After a priming operation, the priming valve control 346 is set to a vertical normal operation position.

Figure 7:
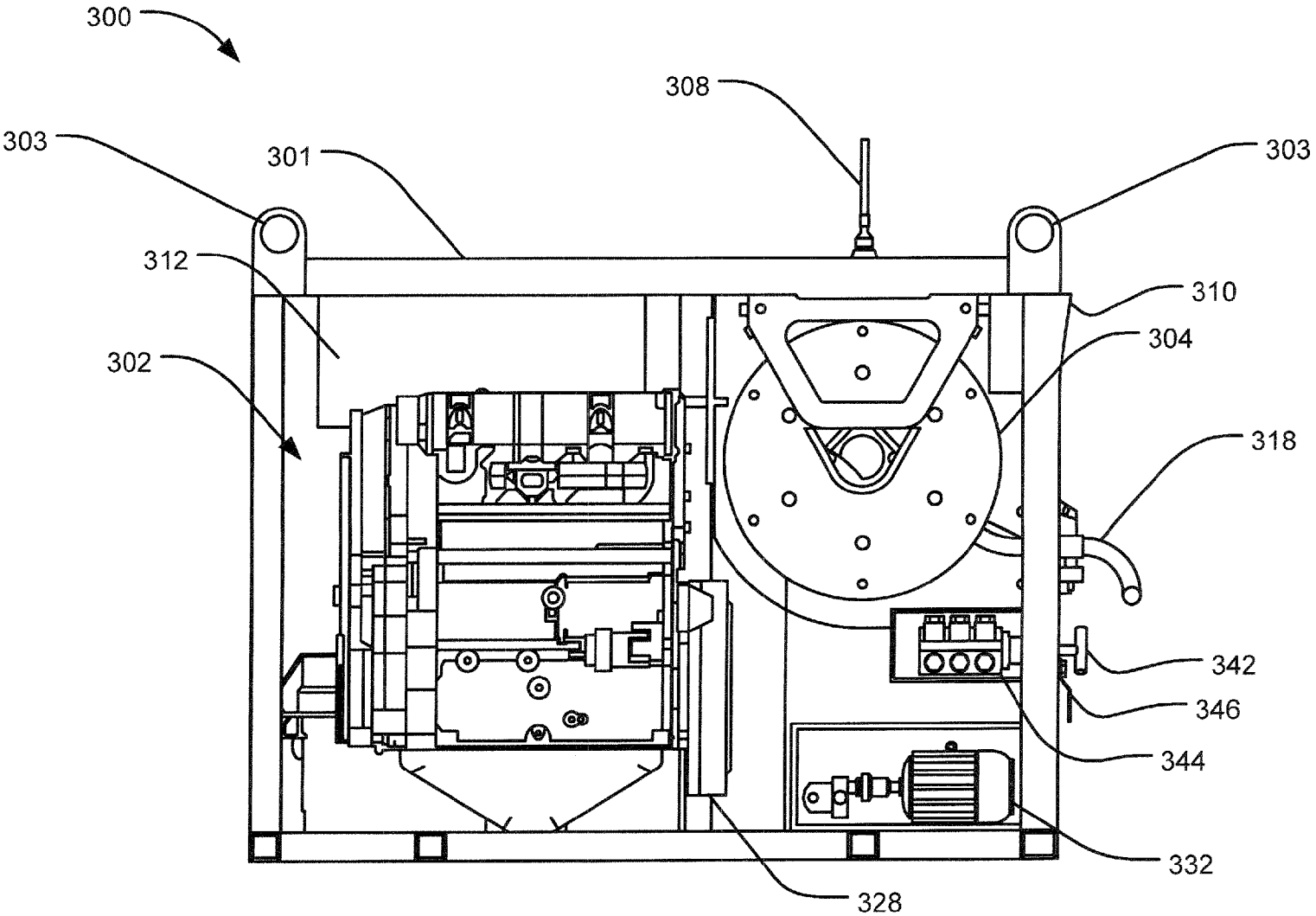
FIG. 7 illustrates a left side view of a fluid jet base station for an example fluid jet system.

FIG. 7 illustrates a left side view of a fluid jet base station 300 for an example fluid jet system. The frame 301 is shown supporting the antenna 308, the eyelets 303, the control panel 310, the hose reel 304, the high pressure pump 332, the engine 302, and the fuel tank 312.

The pump 332 is coupled by drive belt 328 to the main shaft of the engine 302. Although not shown in FIG. 7, the charging pump is also coupled to the main shaft of the engine by another drive belt (see drive belt 328 of FIG. 4). The high pressure pump 332 drives fluid under high pressure into the manifold valves and manifold 330. The high pressure fluid stream emanating from the base station 300 flows through the base station hose 318 when one or more of the valves are open and the pump 332 is providing pressure to the flow.

Figure 8:
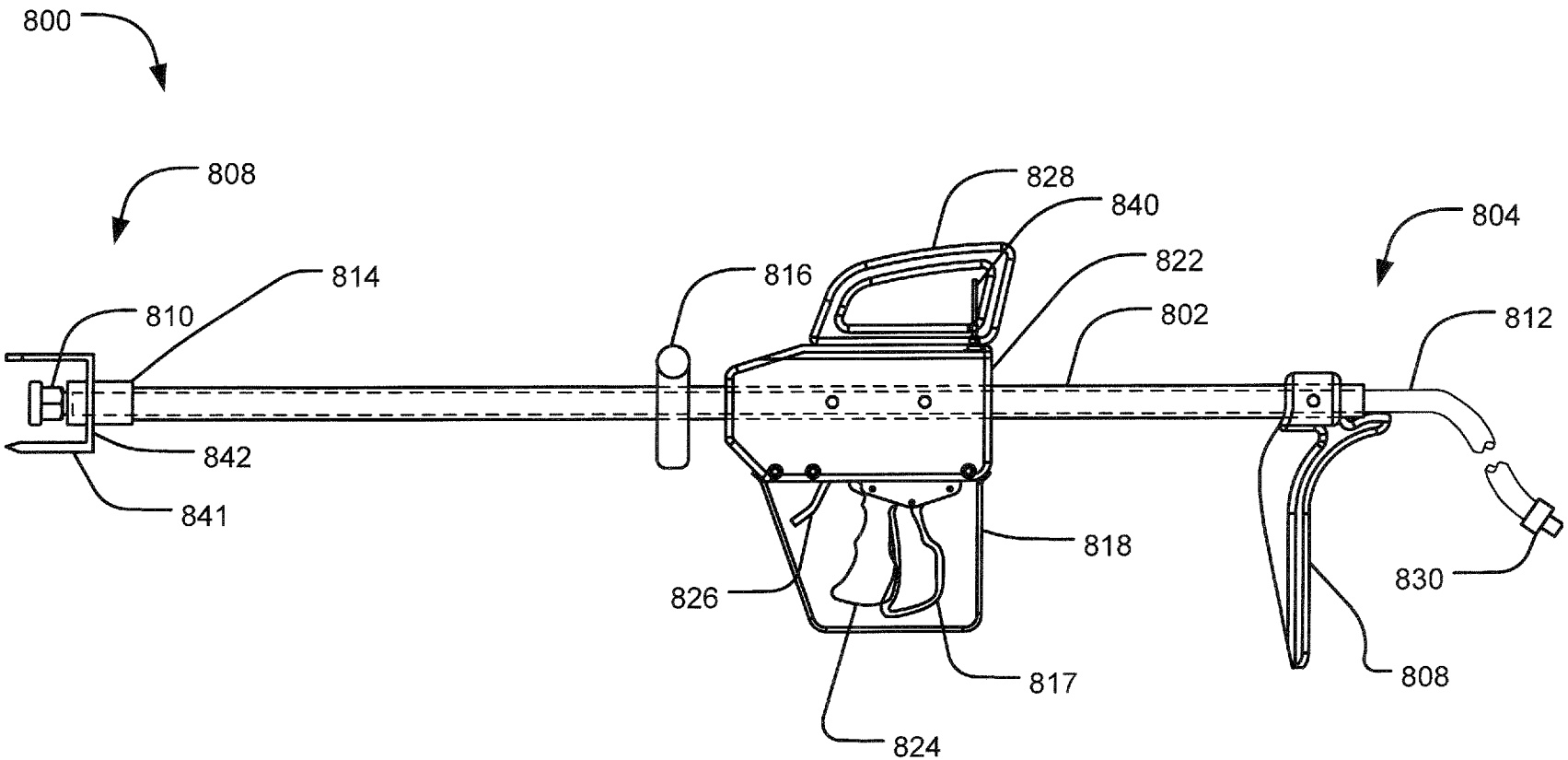
FIG. 8 illustrates a fluid jet assembly for an example fluid jet system.

FIG. 8 illustrates a fluid jet assembly 800 (also referred to as lance 800) for an example fluid jet system. A rigid, hollow lance barrel 802 extends between a proximal end 804 and a distal end 806. A shoulder support 808 is mounted to the lance barrel 802, positioned at the proximal end 808, to provide additional support to an operator operating the fluid jet assembly 800. A nozzle 810 on the distal end 806 shapes the characteristics of the fluid stream as it exits the fluid jet assembly 800.

During operation, the high pressure lance hose 812 is pressurized with a high pressure fluid flow from the base station (see base station 300 in FIGS. 3-7). The lance barrel 802, however, is not pressurized. Instead, a high pressure lance hose 812 threads through the lance barrel 802 between proximal end 804 and the distal end 806 and is anchored (e.g., fixedly secured) at the distal end 806 of the lance barrel 802 by an anchor point 814 and contains the high pressure fluid. In this manner, the high pressure lance hose 812 bears the pressure of the fluid flow while the rigid lance barrel 802 provides a stiff structure to allow the operator to direct the fluid jet when it exits the nozzle 810. For example, in a surface cleaning application, the operator can aim the fluid jet using the rigid lance barrel 802, much as one might aim with a barrel of a firearm. An offset fixture 841 is shown attached to the lance barrel 802 to steady the fluid jet assembly 812 against a structure (not shown). The offset fixture 841 also holds the nozzle 810 away from the surface of the structure by a predetermined distance to minimize damage to the nozzle during operation. A flat side 842 of the offset fixture 841 also acts as a splash shield to protect the operator and the rest of the lance from damage caused by fluid and debris emitted during the cutting operation.

The rigid lance barrel 802 also provides support when the operator presses the distal end of the lance barrel 802 against a structure for cutting. In one implementation, an offset fixture (not shown) may be attached to the distal end of the lance barrel 802 to hold the nozzle 810 a short distance away from the structure. As such, during operation, the fluid jet is directed at a small point or area of the structure in order to cut through the structure, and waste fluid and debris can be evacuated from the cutting area in the offset distance enforced by the offset fixture.

The lance hose 812 extends out the proximal end 804 of the lance barrel 802 and away from the proximal end 804 for a substantial distance to provide a safe separation between the operator and a coupling 830 (see also e.g., coupling 122 in FIG. 1) to the base station hose (see base station hose 124 in FIG. 1). In this manner, a operator is safely protected from two high pressure points of possible failure in the fluid jet system, (1) the anchor point 814 at the distal end 806 of the fluid jet assembly 800 and (2) the high pressure coupling 830 between the lance hose 812 and the base station hose.

An alternative design might include a high pressure coupling at the proximal end of the lance directly between the base station hose and the lance barrel. However, this non-optimal design introduces the risk to the operator of a high pressure coupling in the proximity of the operator's head. In addition, the lance barrel itself is pressurized, introducing yet another possible source of failure. In contrast, the fluid jet assembly 800 shown in FIG. 8 includes a separate lance hose between the base station hose coupling and the nozzle 810. In this manner, the anchor point 814 is separated from the operator by the length of lance barrel 802 while the pressurized lance hose is sheathed within the barrel, and the high pressure coupling 830 between the lance hose 812 and the base station hose is separated from the operator by a substantial distance of lance hose 812 (e.g., from a few feet to over several yards away from the operator).

When an operator is operating the fluid jet assembly 800, the operator positions the shoulder support 808 against his or her shoulder and/or upper torso and aims the nozzle 810 in the desired direction. During operation, the operator holds a barrel handle 816 with one hand and places his or her other hand within the trigger guard 817 and around the trigger post 818, both of which are mounted to a lance manifold 822. The lance manifold 822 houses a microswitch for each trigger (e.g., primary fluid flow trigger 824 and abrasive material flow trigger 826) and a wireless or hardwired transmitter to send command signals back to the base station to control the fluid flow. An antenna 840 is electrically connected to a transmitter located with in the lance manifold 822 and positioned on the top of the lance manifold 822 for communications with the base station. (In the case of a hardwired communications link between the fluid jet assembly 800 and the base station, a communications wire can be run along the lance hose 812 and the base station hose to a receiver in the base station.) To open one or more valves in the base station, the operator closes one or more of the triggers 824 and 826 toward trigger post 818. The lance manifold 822 also includes a handle 828 for easy carrying of the fluid jet assembly 800.

Although the lance hose 812 is shown threading through the lance barrel 802, other implementations may be employed in which the lance hose 812 is only partially enclosed in the lance barrel 802 or even not at all. However, enclosure of the lance hose 812 within the lance barrel 802 provides a compact design that is easy to operate while providing a rigid protective sheath to further enhance the operator's safety in case of lance hose failure or anchor point coupling failure.

Figure 9:
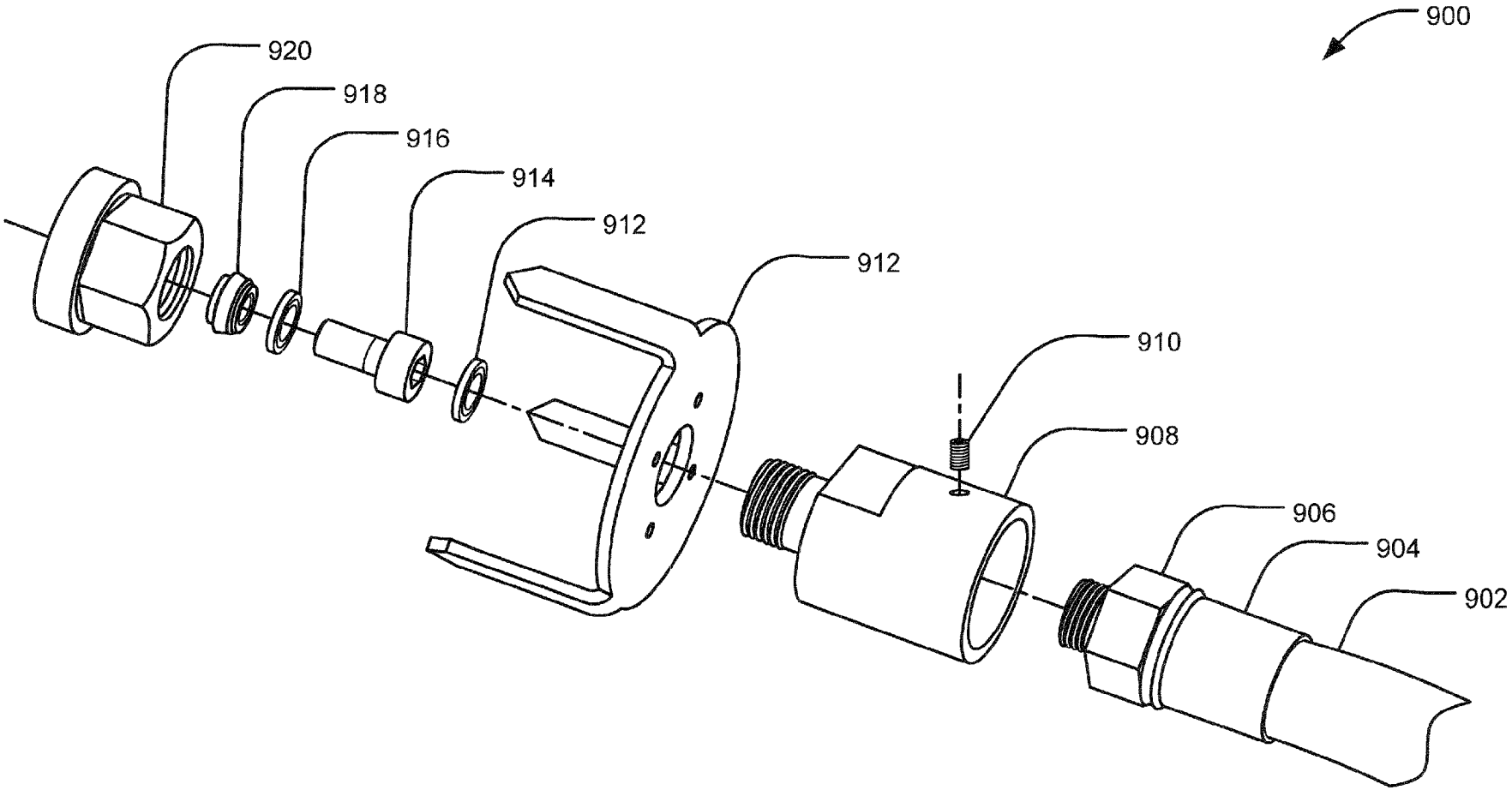
FIG. 9 illustrates an exploded view of the distal end of a fluid jet assembly for an example fluid jet system.

FIG. 9 illustrates an exploded view of the distal end of a fluid jet assembly for an example fluid jet system. A lance hose 902 is capped by a crimp fitting 904, which ends in a threaded male coupling 906. The threaded male coupling 906 screws into a nose connector 908, which also ends in a threaded male coupling. The lance hose 902 threads through a lance barrel (not shown in FIG. 9), which is secured within the nose connector 908 by one or more set screws 910. A three-pronged offset fixture 912 or "nozzle offset" is threaded over the male coupling of the nose connector 908.

A first tip insert 914 is sealed on one end to the nose connector 908 by a seal washer 912. Another seal washer 916 threads over the other end of the first tip insert 914, which inserts into a second tip insert 918. The second tip insert 918 screws into the nozzle 920 (also referred to as a retaining nut), which screws over the male end of the nose connector 908 to anchor the various components between the nozzle 920 and the lance hose 902.

In FIG. 9, the nose connector 908 operates as an anchor point in that it fixedly secures the lance hose to the distal end of the lance barrel. It should be understood that other anchor point configurations may also be employed to anchor the lance hose to the distal end of the lance barrel. By anchoring the pressurized lance hose at the distal end of the lance barrel, the operator is at less risk from a high pressure coupling failure. In addition, the lance barrel need not be a pressurized vessel.

Figure 10:
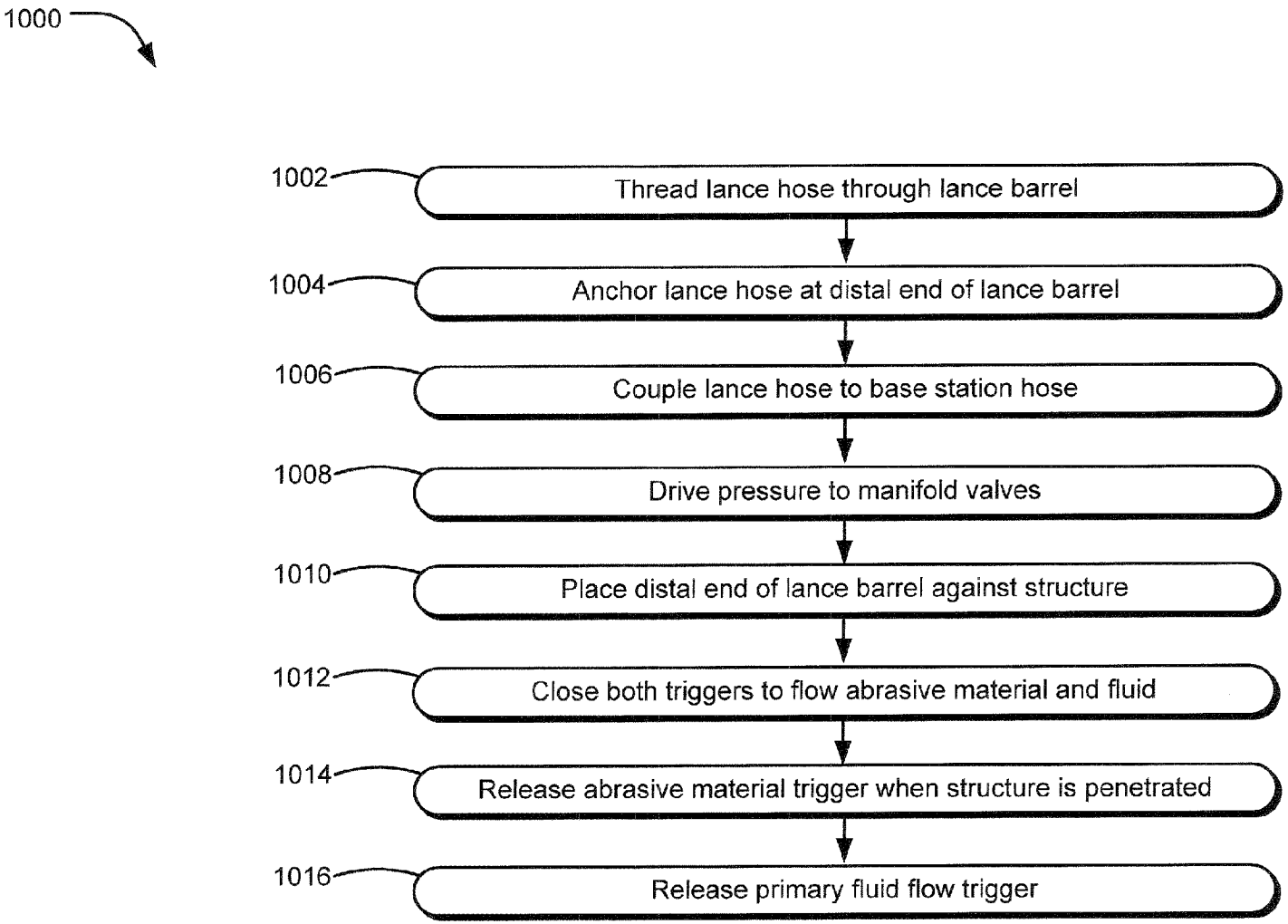
FIG. 10 illustrates example operations for using an example fluid jet system.

FIG. 10 illustrates example operations 1000 for using an example fluid jet system. A cutting operation performed on a structure is used to describe these example operations, but various combinations of these examples operation may be employed for other applications, such as surface cleaning, hydroexcavation, etc.

A threading operation 1002 inserts a high pressure lance hose through a rigid lance barrel of a fluid jet assembly (i.e., lance), wherein the lance barrel need not be a high pressure vessel. In one implementation, the lance hose can be threaded from proximal end to distal end, although either threading direction may be employed. The lance hose includes an end fitting on both ends, for use in coupling to other components. In an anchor operation 1004, one end of the lance hose is fixedly secured to the distal end of the fluid jet assembly via a nose connection that anchors the lance hose end to the lance barrel and the nozzle (i.e., example anchor points). A coupling operation 1006 couples the other end of the lance hose to the base station hose.

A driving operation 1008 starts the engine and drives fluid from a fluid reservoir (though an inline filter) to the manifold valves at high pressure. A placement operation 1010 places the distal end of the fluid jet assembly against a structure. A triggering operation 1012, via two triggers in the fluid jet assembly, opening both manifold valves of the base station to flow fluid at high pressures through the valves. Fluid from one valve flows through an abrasives holding tank and then to a junction to combine with the primary fluid flow from the other valve. This combination of fluid flows travels through the base station hose and lance hose to the distal end of the lance barrel, where a nozzle emits a fluid jet against the structure to effect cutting.

When the cutting operation is completed, the abrasive material trigger is released in a releasing operation 1014 to close the valve connected to the abrasives holding tank, thereby shutting off the flow of abrasive material while continuing the primary flow of fluid (e.g., to maintain the fluid jet into a burning room on the other side of the structure). A releasing operation 1016 releases the primary fluid flow trigger, closing the primary fluid valve and terminating the flow of fluid through the fluid jet assembly.

Figure 11:
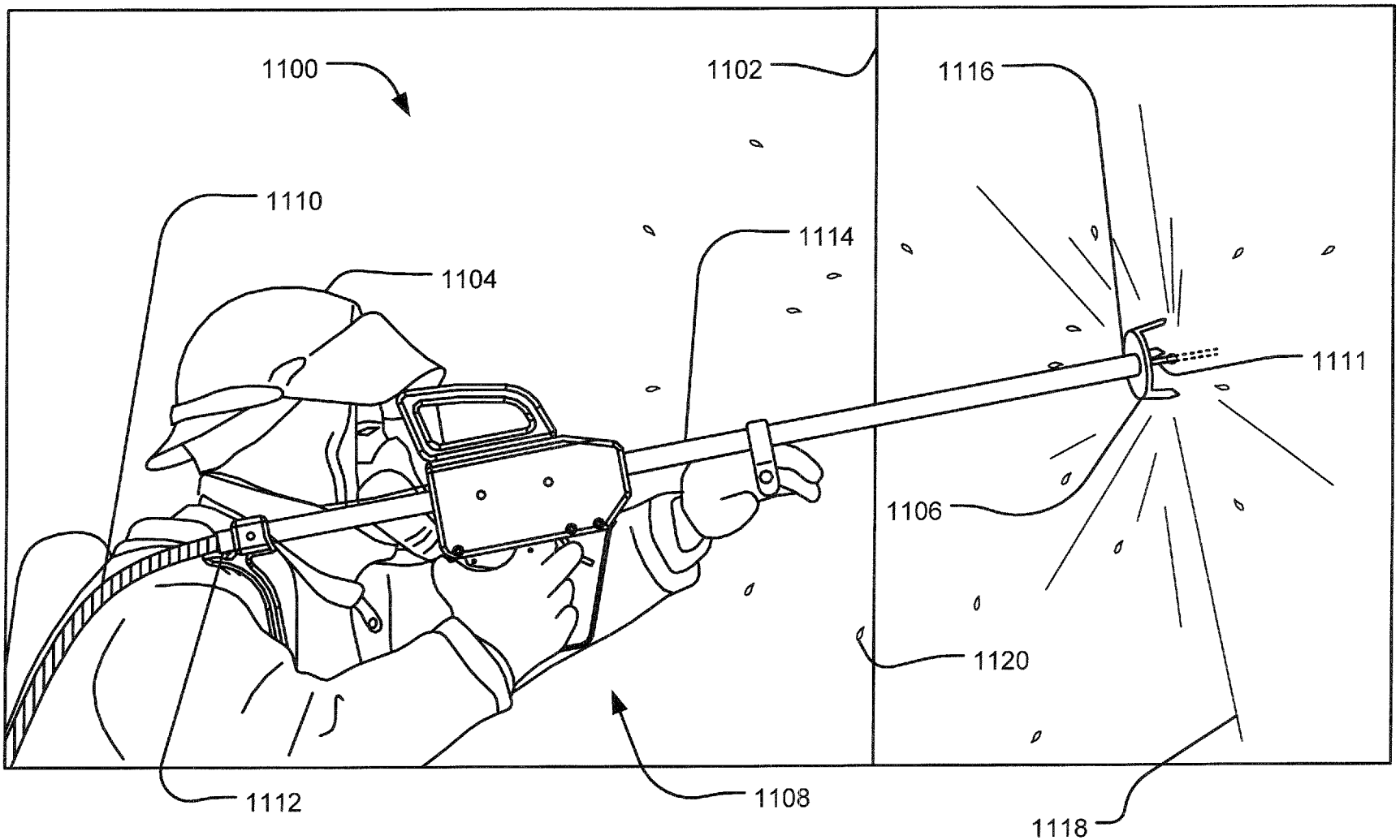
FIG. 11 illustrates a distal end of an example fluid jet assembly during a cutting operation against a surface.

FIG. 11 illustrates a distal end of an example fluid jet assembly 1100 during a cutting operation against a surface 1102. The lance hose 1110 is threaded into the proximal end 1112 of the lance barrel 1114 and anchored at the distal end 1116 of the lance barrel 1112. The operator 1104 is shown as having placed the offset fixture 1106 of the fluid jet assembly 1100 against the surface 1102 and pulled both triggers 1108 to emit a fluid jet 1111 of water and abrasive material toward the surface 1102.

During the cutting operation, the fluid jet 1111 cuts into the surface 1102. In one implementation, the operator 1104 "wiggles" the fluid jet assembly 1100 to cut a hole with a slightly larger diameter than the fluid jet 1111 to allow waste fluid 1118 and debris 1120 to evacuate the hole.

The embodiments of the invention described herein are implemented as logical steps in one or more computer systems. The logical operations of the present invention are implemented (1) as a sequence of processor-implemented steps executing in one or more computer systems and (2) as interconnected machine or circuit modules within one or more computer systems. The implementation is a matter of choice, dependent on the performance requirements of the computer system implementing the invention. Accordingly, the logical operations making up the embodiments of the invention described herein are referred to variously as operations, steps, objects, or modules. Furthermore, it should be understood that logical operations may be performed in any order, unless explicitly claimed otherwise or a specific order is inherently necessitated by the claim language.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A fluid jet lance comprising:

a lance hose configured to couple to a fluid source at a first end of the lance hose, wherein the lance hose is configured to transport a pressurized fluid flow;

a lance barrel having a distal end and a proximal end, the lance barrel being configured to receive the lance hose such that the lance hose extends through the barrel between the distal end and the proximal end;

a handle located between the distal end and the proximal end of the lance barrel, the handle configured to allow an operator to steady the fluid jet lance distal end of the lance barrel against a surface; and an anchor point at the distal end of the lance barrel configured to fixedly secure a second end of the lance hose to the distal end of the lance barrel; and an offset fixture configured to hold the distal end of the lance barrel away from an adjacent surface and steady the fluid jet lance against the surface.

2. The fluid jet lance of claim 1 wherein the lance hose is a high pressure hose and the lance barrel is rigid.

3. The fluid jet lance of claim 1 wherein the lance hose threads through the lance barrel between the distal end and the proximal end.

4. The fluid jet lance of claim 1 wherein the lance hose extends a safe distance from the operator of the fluid jet lance before coupling to a base station hose.

5. The fluid jet lance of claim 1 wherein the anchor point comprises:

a nozzle through which a fluid jet flows.

6. The fluid jet lance of claim 1 wherein the anchor point comprises:

a nose connection device fixedly securing the lance hose to the distal end of the lance barrel.

7. The fluid jet lance of claim 5 wherein the offset fixture is anchored between the nozzle and the lance hose.

8. The fluid jet lance of claim 1 further comprising:

a wireless transmitter that transmits signals for opening and closing valves in a fluid jet base station.

9. The fluid jet lance of claim 1 further comprising:

a first selector configured to send a signal to a receiver in a fluid jet base station to cause a valve in an abrasive material line to open and close; and a second selector configured to send a signal to the receiver in the fluid jet base station to cause a valve in an primary fluid line to open and close.

10. The fluid jet lance of claim 1 wherein the lance barrel is not pressurized when high pressure fluid is flowing through the lance hose.

11. A method of operating a fluid jet lance, the method comprising:

threading a lance hose through a lance barrel of the fluid jet lance;

anchoring a distal end of the lance hose at a distal end of the lance barrel;

steadying the fluid jet lance against an adjacent surface using a handle located between the distal end and the proximal end of the lance barrel and an offset fixture that holds the distal end of the lance barrel away from the adjacent surface; and driving high pressure fluid to flow through the lance hose, wherein the high pressure fluid is emitted through the distal ends of the lance hose and lance barrel.

12. The method of claim 11 wherein the high pressure fluid includes a combination of water and an abrasive material.

13. The method of claim 12 further comprising:

terminating the flow of abrasive material through the lance hose while maintaining the flow of water through the lance hose.

14. The method of claim 11 further comprising:

coupling an end of the lance hose opposite the distal end to a fluid source.

15. The method of claim 14 wherein the fluid jet lance is held and operated by an operator and further comprising:

coupling an end of the lance hose opposite the distal end to a high pressure coupling located a safe distance from the operator.

16. The method of claim 14 wherein the fluid source is a base station hose from a fluid jet base station.

17. The fluid jet lance of claim 1, wherein the pressurized fluid flow includes a combination of water and an abrasive material.

18. The fluid jet lance of claim 1, wherein the pressurized fluid flow includes a combination of water and foam.

19. The method of claim 11, wherein the high pressure fluid includes a combination of water and foam.

* * * * *